US005235245A

United States Patent [19]

Uchimura et al.

[11] Patent Number: 5,235,245

[45] Date of Patent: Aug. 10, 1993

[54] METALLIC FRAME INCLUDING LEADS INCORPORATING A DEFORMABLE PART FOR USE IN A FLUORESCENT DISPLAY PANEL

[75] Inventors: Takeshi Uchimura; Masaharu Satonaka, both of Kagoshima, Japan

[73] Assignee: NEC Corporation, Tokyo, Japan

[21] Appl. No.: 779,814

[22] Filed: Oct. 21, 1991

[30] Foreign Application Priority Data

Oct. 19, 1990 [JP] Japan ..... 2-282497

[51] Int. Cl.[5] ..... H01J 1/88

[52] U.S. Cl. ..... 313/496; 313/239; 313/520; 29/827

[58] Field of Search ..... 313/496, 497, 517, 519, 313/520, 521, 239; 29/827, 883

[56] References Cited

U.S. PATENT DOCUMENTS 3,819,975 6/1975 Kunii et al. ..... 313/517

FOREIGN PATENT DOCUMENTS 0010964 1/1978 Japan ..... 313/497
0056343 4/1980 Japan ..... 313/496
0050039 5/1981 Japan ..... 313/496

OTHER PUBLICATIONS

Chip-In-Glass Fluorescent Indicator Panel, NEC Research and Development, No. 93, pp. 47-56, Apr. 1989, Murayama.

*Primary Examiner*—Donald J. Yusko
*Assistant Examiner*—N. D. Patel
*Attorney, Agent, or Firm*—Leydig, Voit & Mayer

[57] ABSTRACT

A metallic frame for use in a fluorescent display panel having a CIG (chip in glass) structure and containing a driver IC chip in a vacuum chamber. The metallic frame includes a box-type metallic shield covering the IC chip, metallic external leads, and a deformable part coupled between the box-type metallic shield and the metallic external leads. The deformable part deforms more easily than the metallic shield and the leads upon receiving a tensile force. The deformable part is preferably formed at a bent section of the metallic shield or near a shield side end of the metallic external leads. The deformable part preferably consists of two bent or curved elements which are positioned to form a circle, ellipse, or polygon.

14 Claims, 4 Drawing Sheets

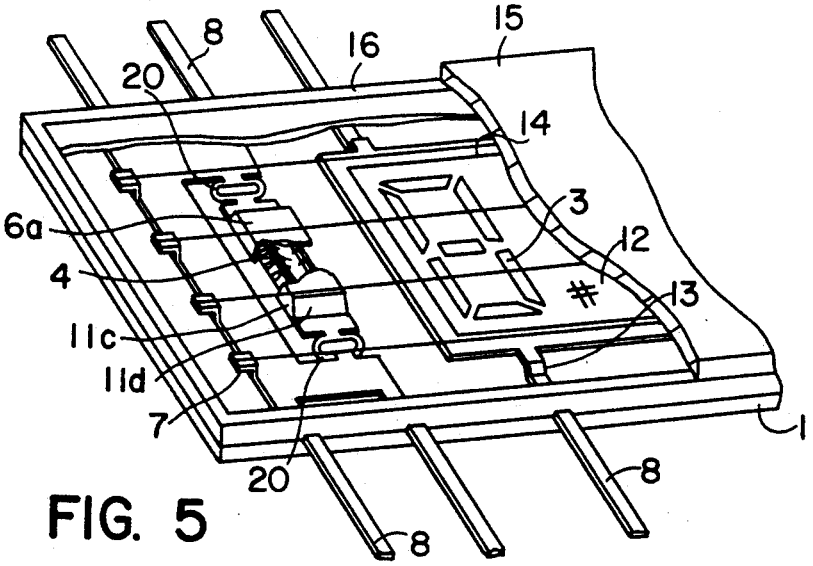
FIG. 5
FIG. 6A
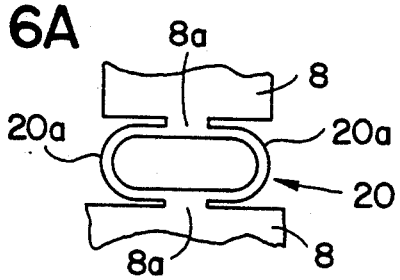
FIG. 6B
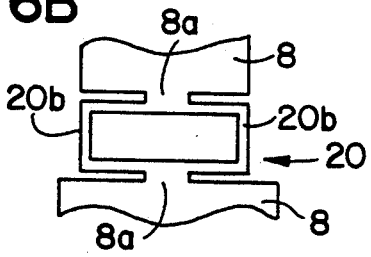
FIG. 6C
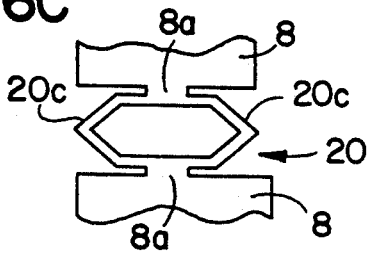

METALLIC FRAME INCLUDING LEADS INCORPORATING A DEFORMABLE PART FOR USE IN A FLUORESCENT DISPLAY PANEL

BACKGROUND OF THE INVENTION

1. Field of the Invention

This invention relates to a fluorescent display panel. More particularly this invention relates to a fluorescent display panel having a CIG (chip in glass) structure containing a driver integrated circuit chip.

2. Description of the Prior Art

This type of fluorescent display panel generally has a vacuum chamber enclosed by an insulating substrate and a glass cover fixed thereon. The vacuum chamber contains an anode fixed on the substrate and having a fluorescent material applied thereon to form a display pattern. Spaced filaments are disposed opposed to the anode. A grid is placed between the anode and the filaments. An integrated circuit chip (IC chip) drives to drive the anode or the grid. The IC chip is fixed on the substrate and covered with a box type metallic shield to protect it from an electromagnetic field. On both sides of the shield, external leads, which are projected from the vacuum chamber, are connected.

A proposed method of fabricating such a conventional fluorescent display panel is to prepare a flat metallic frame of monolithic formation of grid supports, filament supports, an IC chip shield and external leads, and to press-mold the frame. The shield is formed into a box shape by this process. This proposed method, however, has a disadvantage of dispersion of position and/or height of the formed shield because the shield is press-molded while it projects the connected external leads on both sides, which may result in the production of a substandard shaped shield. Dispersion of shield height is critical, because it will degrade the shielding effect.

Further, this method has a problem of misalignment of position and/or height of the grid supports and/or the filament supports because the frame itself is subjected to a slight deformation during the molding process.

Accordingly, an object of this invention is to provide a fluorescent display panel which allows the position and height of an IC chip protection shield to be set with a high accuracy.

Another object of this invention is to provide a fluorescent display panel which allows accurate setting of the position and height of elements other than the IC chip protection shield including grid supports and filament supports.

SUMMARY OF THE INVENTION

According to this invention, a fluorescent display panel is characterized by a part which is deformable under an applied tensile force more easily than the IC chip protection shield and the external leads connected to the shield. The part is positioned in the vicinity of each junction between the shield and the associated external leads. During the press-molding process of a flat metallic frame having a monolithic structure of the shield and the leads to form the shield into box shape, if a tensile force is applied between the shield and the leads, then a large tensile stress is induced at the junctions of the shield and the leads. This is because a large portion of the force is applied to the junctions of the shields and the leads. Due to the deformable part placed in the vicinity of the junction, the fluorescent display panel of this invention may absorb the force by the extension of the deformable part depending on the magnitude of applied force. This prevents the shield and the leads from being subjected to excess tensile force. A configuration containing the deformable parts provides a fluorescent display panel having an accurate setting of position and height of the shield.

As described above, with this method, the frame itself is hardly deformed during the molding process so that the position and height of the elements other than the shield, such as grid supports and filament supports, can also be set at a high accuracy.

The shield is provided with one or more external leads on each side. When the number of the leads is more than one on each side, the deformable part is located on every junction between the shield and each lead.

In a preferable mode of this invention, the deformable part is formed at a bend section of the shield. In this case, the part becomes nearly perpendicular to the insulating substrate. The shield is connected with the lead via the part.

In another preferable mode of this invention, the deformable part is provided near the shield side end of the lead connected thereto. In this case, the part becomes nearly parallel to the substrate.

The deformable part preferably consists of one or more bent or curved elements. This configuration has an advantage to obtain easily a designed deformable part by only forming a part of the shield or the lead to follow the desired shape. The width and/or thickness of these elements are preferably kept smaller than those of the shield and the leads.

The number of the bent or curved elements may be either one or more for each junction between the shield and the associated leads. Nevertheless, it is preferable to position two such elements symmetrically to the longer axis of the lead, which arrangement prevents the shield and the lead from excess force application because both of the elements are deformed symmetrically on receiving a tensile force.

The symmetrically positioned two bent or curved elements are preferably two outwardly curved near circular arc elements forming a near circle or near ellipse. They may also be two elements forming a polygon, for example, two outwardly bent near U shape elements forming a near rectangle or two outwardly bent near V shape elements forming a near hexagon.

BRIEF DESCRIPTION OF THE DRAWINGS

FIG. 5 is a part perspective view similar to FIG. 1 showing the second embodiment of this invention;

FIG. 6A is a part plan showing the deformable part in the second embodiment;

FIG. 6B is a part plan showing another example of the deformable part in the second embodiment;

FIG. 6C is a part plan showing further example of the deformable part in the second embodiment.

DESCRIPTION OF THE PREFERRED EMBODIMENTS

Figure 1:
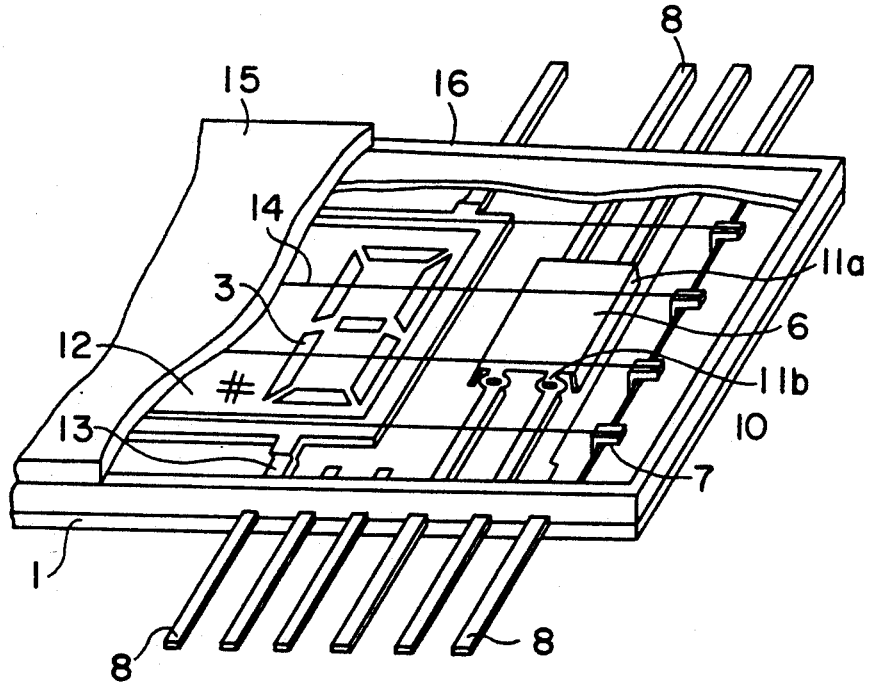
FIG. 1 is a part perspective view of the first embodiment of fluorescent display panel of this invention with a part cut of cover glass.
Figure 2:
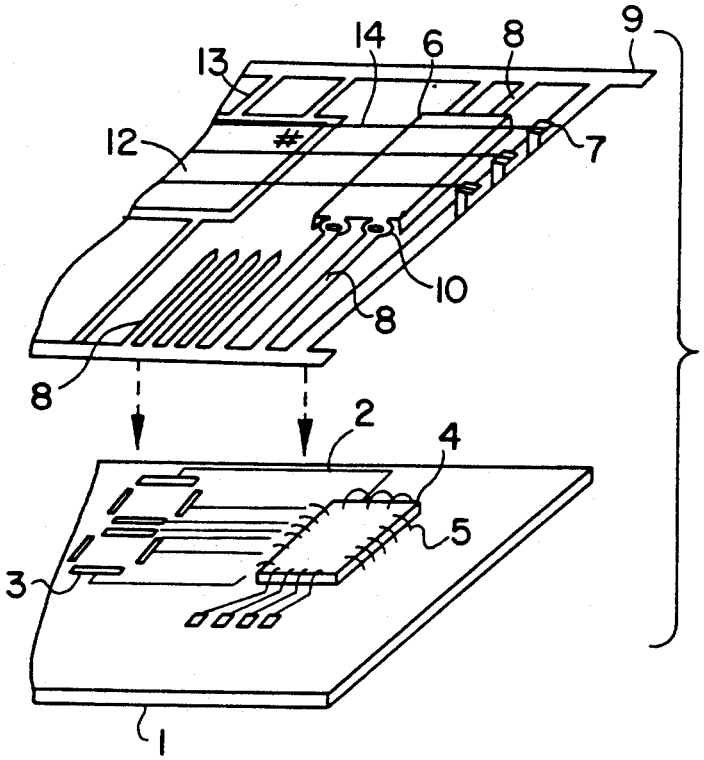
FIG. 2 is a part perspective view showing the elements assembly of the first embodiment.

This invention is described to a greater detail in the following embodiments referring to the drawing.

First Embodiment

FIG. 1 through FIG. 4C illustrate the first embodiment of this invention. The fluorescent display panel shown in FIG. 1 has a vacuum chamber enclosed by an insulating substrate 1 and a display glass 15 fixed to the substrate 1 via a spacer glass 16. The vacuum chamber contains an anode 3 which is fixed on the substrate 1 and is applied with fluorescent material to form a display pattern, spaced filaments 14 disposed opposed to the anode 3, a grid 12 placed between the anode 3 and the filaments 14, an IC chip 4 (refer to FIG. 2) fixed on the substrate 1 and drive the anode 3, a box type metallic shield 6 to protect the IC chip 4, and metallic external leads 8 projected from both sides of the vacuum chamber.

The filaments 14 are fixed to the filament supports 7 at both ends thereof and the grid 12 is fixed to the grid supports 13. The shield 6 has a shape of bottomless box and covers the IC chip 4 and is connected to two external leads 8 at both ends of longitudinal side. The shield 6 is provided with ring shaped deformable parts 10 in the vicinity of the junctions with the leads 8.

Figure 4A:
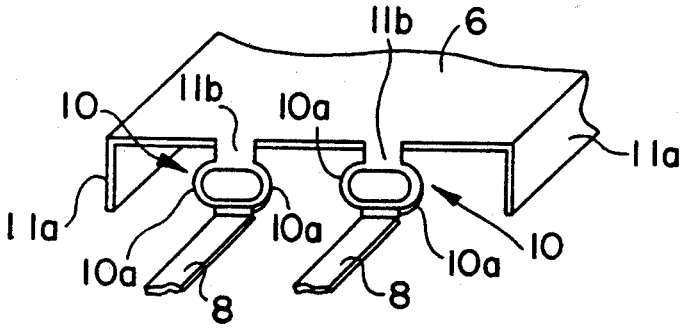
FIG. 4A is a part perspective view showing the after-molding state of the shield of the first embodiment.

FIG. 4A shows a detail structure of the junction between the shield 6 and the associated lead 8. The shield 6 has a central rectangular part, two bend sections 11*a* which cover the longitudinal side of the IC chip 4, and two bend sections 11*b* which face the sides perpendicular to the longitudinal sides of the IC chip 4. At every one end of the two bend sections 11*b*, a ring shaped deformable part 10 is formed through which each of the leads 8 is connected to the shield 6. The deformable parts 10 are positioned at nearly right angle to the substrate 1.

In the first embodiment, each of the deformable part 10 consists of two outwardly curved circular arc elements 10*a*, and these elements 10*a* form near ellipse. The thickness of each element 10*a* is the same with that of the shield 6 and of the leads 8 connecting to the shield 6, and the width of the element 10*a* is less than thereof. This configuration allows the deformable part 10 to be readily deformed on receiving a tensile force compared with the shield 6 and the leads 8.

The fabrication procedure of the fluorescent display panel having the structure described above is illustrated referring to FIG. 2 and FIG. 3.

First, an aluminum thin film is formed on one side of the insulating substrate 1 by sputtering process, and the wiring layer 2 is formed on the thin film using photolithography process. Over the wiring layer 2, an insulating layer (not shown) is formed using a thick film technology and the anode 3 is formed on the insulating layer using a thick film technology. The anode 3 consists of graphite electrodes coated with fluorescent material. The resulted composite product is the anode substrate.

Second, the IC chip 4 is fixed on the insulating layer of the anode substrate using a heat resistant resin, and the output terminals of the IC chip 4 are connected to the wiring layer 2 to obtain an anode substrate packaged with the IC chip 4.

A metallic plate is etched to form a flat metallic frame 9 which integrates the shield 6, filament supports 7, grid supports 13, and external leads 8. After the treatment of the frame 9 in a moistened hydrogen atmosphere, the shield 6, filament supports 7, grid supports 13 and external leads 8 simultaneously undergo the press-molding process to obtain a frame shown in FIG. 2.

Then, the filaments 14 and the grid 12 are welded to the filament supports 7 and grid supports 13 on the formed frame 9, respectively. On the anode substrate, the frame 9 fixed with the filaments 14 and other elements is combined with a cover glass which consists of the spacer glass 16 and the display glass 15 to integrate the anode substrate, the frame 9 and the cover glass. Then the peripheral part of the frame 9 are cut off to adjust the length of the projected leads 8.

Next, the integrated product is heated to seal the contact edge of the anode substrate with the cover glass and to seal the projected part of the leads 8. Then the formed vacuum chamber is evacuated. After solder coating on the leads 8, aging is applied to obtain a designed characteristic. The resulted product is the fluorescent character display tube shown in FIG. 1.

Figure 3:
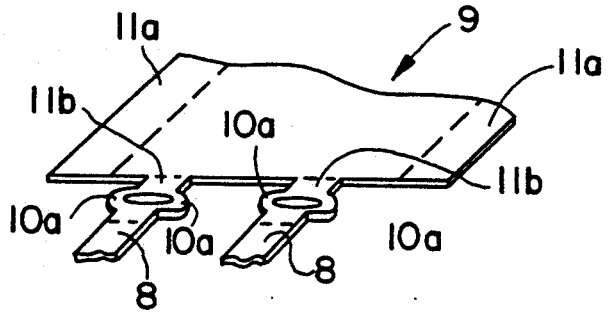
FIG. 3 is a part perspective view showing the before-molding state of the shield of the first embodiment.

FIG. 3 shows the structure at and around the deformable parts 10 of the shield 6 before molding. The shield 6 before molding is a rectangular flat plate provided with bent sections 11*a* and 11*b* on the periphery thereof. Each bent section 11*b* has a ring shaped deformable part 10 which connects to the end of the lead 8. Two outwardly curved circular arc elements 10*a*, which are symmetrically positioned to form the deformable part 10 in an elliptical shape, have the same thickness with the bent section 11*b* and the leads 8 and have a narrower width than thereof. The configuration of the deformable part 10, which has the narrower width and is supported on both ends thereof, allows the deformable part to be readily extended depending on the tensile force induced during the molding process. Thus, the distance between the shield 6 and the associated leads 8 is automatically adjusted. As a result, the shield 6 and the leads 8 connected thereto are not subjected to excess force and do not generate unwelcome dispersion of the position and height of the shield 6 during the molding process.

In addition, the frame 9 is hardly deformed owing to the prevention from pulling by the leads 8 connected to the shield 6, so there is no possibility of dispersion of position and/or height of the shield 6 and also of other elements such as the filament supports 7.

Figure 4B:
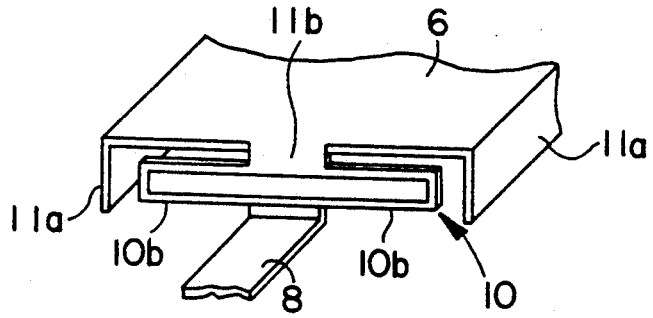
FIG. 4B is a part perspective view showing another example of the deformable part in the first embodiment.
Figure 4C:
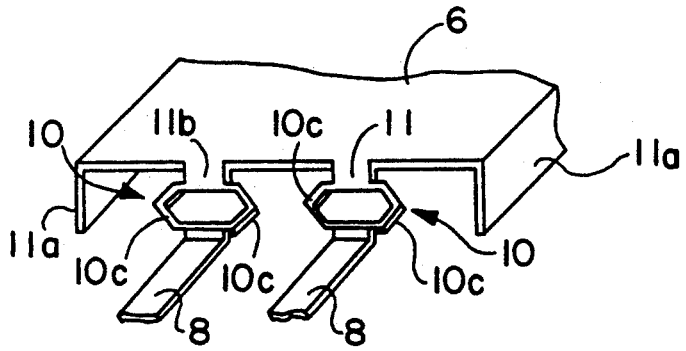
FIG. 4C is a part perspective view showing further example of the deformable part in the first embodiment.

FIG. 4B and FIG. 4C show other examples of the deformable part 10. In FIG. 4B, one bent section 11*b* and one lead 8 is provided on each side of the shield 6. The deformable part 10 consists of two elements 10*b*, each of which is bent to near U shape. Both elements 10*b* are positioned symmetrically to the longer axis of the lead 8 and are connected each other to form a rectangle.

In FIG. 4C, each two bent sections 11*b* and leads 8 are positioned on both sides of the shield 6, as in the case of FIG. 4A. The deformable part 10 consists of two elements 10*c*, each of which is bent to near V shape. These elements 10*c* are positioned symmetrically to the longer axis of the leads 8 to form a hexagon.

Second Embodiment

FIG. 5 and FIG. 6A through FIG. 6C show the second embodiment of this invention. Similar to the aforedescribed first embodiment, the fluorescent display panel shown in FIG. 5 has a vacuum chamber enclosed by the substrate 1, the spacer glass 16 and the display glass 15, which vacuum chamber contains the anode 3, filaments 14, grid 12, IC chip 4, box type metallic shield 6a to protect the IC chip 4 and metallic external leads 8. The differences of the second embodiment from the first embodiment are that the shield 6a covers most part of the IC chip 4 and that the ring shaped deformable parts 20 are positioned not on the shield 6a but on the leads 8. One deformable part 20 and one lead 8 are provided on eachside of the shield 6a.

The shield 6a is in a bottomless box shape and is connected to the leads 8 on both sides thereof. The bend section 11c of the shield 6a has the same configuration with the bend section 11a of the shield 6 in the first embodiment and covers almost all the longitudinal side of the IC chip 4. The bend section 11d of the shield 6a covers almost all the area of both sides positioned at right angle to the longitudinal sides of the IC chip 4, which is different from the case of the bent section 11b in the first embodiment.

The deformable parts 20 are located near to the shield side end of the leads 8 which are connected to the shield 6a. In this case, the deformable parts 20 become nearly parallel to the substrate 1. The detail of the deformable parts 20 is illustrated in FIG. 6A. The deformable part 20 consists of two circular arc elements 20a positioned to form an ellipse similar to the deformable part 10 of the first embodiment shown in FIG. 4. These two circular arc elements 20a are connected to the main body of the leads 8 via the narrow connecting parts 8a. The thickness of the elements 20a are the same with that of the shield 6a and of the leads 8 connected to the shield 6a. However, the width of the elements 20a are narrower than thereof the elements 20a and the leads 8. Thus generation of a tensile force deforms the deformable parts 20 more easily than the shield 6a and the leads 8.

As described above, the second embodiment does not employ the deformable parts 20 on the shield 6a so that most of the IC chip surface can be covered. As a result, almost all of the peripheral surface of IC chip 4 can be covered, which offers an advantage of more certain shield effect than in the case of the first embodiment.

The fabrication method of fluorescent display panel of the second embodiment is the same as in the first embodiment. The shield 6a, the filament supports 7, the grid supports 13, and the external leads 8 are formed on one metallic frame for one-shot press-molding, similar to the case of the first embodiment. A tensile force generated during the molding process between the shield 6a and the leads 8 connected thereto pulls and extends the circular arc elements 20a of the deformable parts 20 to adjust the distance between the shield 6a and the leads 8.

FIG. 6B and FIG. 6C show other examples of the deformable parts 20. In FIG. 6B, the deformable part 20 consists of two elements 20b each of which is bent to near U shape. Both elements 20b are positioned symmetrically to the longitudinal axis of the corresponding leads 8 and are connected to the narrow connecting parts 8a to form a rectangle.

In FIG. 6C, the deformable part 20 consists of two elements 20c each of which is bent to near V shape. Both elements 20c are positioned symmetrically to the longitudinal axis of the corresponding leads 8 and are connected to the narrow connecting parts 8a to form a hexagon.

Both embodiments aforedescribed employ the deformable part consisting of two bent or curved elements. However, the deformable part may consist of single element described above or may consist of more than two elements. The necessary condition is to have a deformable part which is deformed on receiving a tensile force more easily than the shield and the external leads connected thereto.

Further, in both embodiments aforedescribed, the deformable part is formed by lowering their strength by employing a local reduction of width at the bend section of the shield or width of the external leads. Nevertheless, the deformable part may be formed by lowering the strength by employing a locally thin thickness or by employing a locally thin thickness and narrow width at a time.

The shape of the shield and the number or shape of the external leads connecting thereto may be arbitrarily selected.

What is claimed is:

1. A metallic frame for use in a fluorescent display panel, the fluorescent display panel including a vacuum chamber enclosed by an insulating substrate and a cover fixed thereon, an IC chip for driving at least more than one electrode, a box type metallic shield covering the chip for protecting it, and metallic external leads, the metallic frame comprising:

a deformable part integral with and coupled between said metallic shield and said metallic external leads, said deformable part being deformable more easily than said metallic shield and said metallic external leads on receiving a tensile force.

2. The metallic frame of claim 1 wherein said deformable part is formed at a bent section of said metallic shield.

3. The metallic frame of claim 2 wherein said deformable part includes at least one element, said element being at least one of a bent element and a curved element.

4. The metallic frame of claim 3 wherein at least one of the width and the thickness of said element is smaller than that of a bent section of the metallic shield.

5. The metallic frame of claim 3 wherein said deformable part includes two elements, said elements being symmetrically positioned.

6. The metallic frame of claim 5 wherein said two elements are positioned to form a near circle or a near ellipse.

7. The metallic frame of claim 5 wherein said two elements are positioned to form a near polygon.

8. The metallic frame of claim 1 wherein said deformable part is positioned near the metallic shield side of said metallic external leads.

9. The metallic frame of claim 8 wherein said deformable part includes an element, said element being at least one of a bent element and a curved element.

10. The metallic frame of claim 9 wherein at least one of the width and the thickness of said element is smaller than that of a bent section of the metallic shield.

11. The metallic frame of claim 9 wherein said deformable part includes two elements, said elements being symmetrically positioned.

12. The metallic frame of claim 11 wherein said two elements are positioned to form a near circle or a near ellipse.

13. The metallic frame of claim 11 wherein said two elements are positioned to form a near polygon.

14. A metallic frame for use in a fluorescent display device comprising:

a box-type metallic shield;

a metallic external lead;

a deformable part integral with and coupled between the box-type metallic shield and the metallic external lead, the deformable part being deformable more easily than said box-type metallic shield and said metallic external lead upon receiving a tensile force.

* * * * *